United States Patent [19]

Blanchard et al.

[11] 4,304,565

[45] * Dec. 8, 1981

[54] PROCESS FOR PRODUCING TRANSFER PRINTED COTTON AND COTTON BLENDS

[75] Inventors: Eugene J. Blanchard, New Orleans; Gloria A. Gautreaux, Mandeville; Robert J. Harper, Jr., Metairie, all of La.

[73] Assignee: The United States of America as represented by the Secretary of Agriculture, Washington, D.C.

[ * ] Notice: The portion of the term of this patent subsequent to Dec. 2, 1997, has been disclaimed.

[21] Appl. No.: 212,297

[22] Filed: Dec. 3, 1980

Related U.S. Application Data

[63] Continuation-in-part of Ser. No. 83,697, Oct. 11, 1979, abandoned, which is a continuation-in-part of Ser. No. 913,418, Jun. 7, 1978, Pat. No. 4,236,890.

[51] Int. Cl.[3] ..... D06P 5/00; D06P 3/60; D06P 3/85

[52] U.S. Cl. ..... 8/471; 8/467; 8/495

[58] Field of Search ..... 8/467, 471, 495

[56] References Cited

U.S. PATENT DOCUMENTS

| | | | |
|---|---|---|---|
| 3,948,600 | 4/1976 | Reinhardt et al. | 8/183 |
| 4,063,879 | 12/1977 | Faulhaber et al. | 8/2.5 R |
| 4,072,462 | 2/1978 | Vellins et al. | 8/2.5 A |

FOREIGN PATENT DOCUMENTS

| | | | |
|---|---|---|---|
| 2309665 | 11/1976 | France | 8/2.5 A |
| 2315524 | 1/1977 | France | 8/17 |
| 1243223 | 8/1971 | United Kingdom | 8/2.5 A |
| 1460742 | 4/1976 | United Kingdom . | |
| 1445201 | 8/1976 | United Kingdom | 8/2.5 A |

OTHER PUBLICATIONS

Wild, K. Jour. Soc. of Dyers & Colorists May 1977, pp. 185–188.

*Primary Examiner*—Maria Parrish Tungol
*Attorney, Agent, or Firm*—M. Howard Silverstein; David G. McConnell; Raymond C. VonBodungen

[57] ABSTRACT

A process is disclosed for the heat transfer printing of cellulose-containing fabrics in garment form with disperse dyestuffs, wherein the fabric is treated only on one side by a printing or spraying technique with a formulation containing highly methylated melamine-formaldehyde crosslinking agent, acid catalyst, and other necessary additives. Fabrics with prints that are durable to washing are produced by simultaneously heat transfer printing and curing at about 190° C. to 220° C. for 20–30 seconds.

10 Claims, No Drawings

PROCESS FOR PRODUCING TRANSFER PRINTED COTTON AND COTTON BLENDS

CROSS-REFERENCE TO RELATED APPLICATIONS

This is a continuation-in-part of Ser. No. 83,697, filed Oct. 11, 1979 now abandoned which is a continuation-in-part of Ser. No. 913,418, filed June 7, 1978 now U.S. Pat. No. 4,236,890.

BACKGROUND OF THE INVENTION (1) Field of the Invention

This invention relates to the heat transfer printing of fabrics with disperse dyes. More specifically it relates to the screen printing or spraying of cellulose-containing textile materials with a crosslinking system to improve the affinity of such textiles for disperse dyestuffs.

(2) Description of the Prior Art

Heat transfer printing is a process whereby a paper containing disperse dyestuffs on the surface is placed in contact with a suitable material and heated, so that the sublimable dyes are transferred from paper to fabric. Unmodified cellulose cannot be effectively heat transfer printed with disperse dyes because of a lack of affinity. Very little dye is adsorbed by the cellulose, and this small amount is removed upon washing. This is in marked contrast to the effect obtained with some synthetic textiles, such as polyester, which have excellent affinity for disperse dyes.

Lambert, British Pat. No. 1,445,201, has demonstrated that the affinity of a cellulose-containing textile for disperse dyes can be improved by treatment with a methylated melamine-formaldehyde resin in which there are five-$CH_2OCH_3$ groups per melamine group. The fabric is printed by heating for 3 minutes at 200°-210° C. with transfer paper containing disperse dyes. This longer printing time is needed because of the use of a weaker catalyst, such as $(NH_4)H_2PO_4$, than is usually used for resin finishing of cellulose.

British Pat. No. 1,460,742 teaches that cellulose-containing fabrics can be effectively transfer printed with disperse dyestuffs if the fabric is impregnated with at least one curable resin containing one or more hydroxymethyl, alkoxymethyl or aldehyde groups that are capable of reacting with the disperse dyestuffs.

Faulhaber et al, U.S. Pat. No. 4,063,879, teaches that the fabric has to be impregnated with the aminoplast and then transfer printed by sublimation from a paper containing a disperse dyestuff and volatile acid, or metal or ammonium salt of the volatile acid.

Vellins et al, U.S. Pat. No. 4,072,462 specifies the use of disperse dyes with reactive groups which can react with the aminoplast during the printing process to obtain colorfastness to washing. Vellins teaches that free acids are not generally used as catalysts because they adversely affect bath stability.

Transfer printing on garments is described in British Pat. No. 1,243,223 in which case a garment of wool fibers is contacted with an aluminum plate containing a basic dye.

SUMMARY OF THE INVENTION

This invention provides a method for the treatment of cellulose-containing fabrics in garment form with a stable pretreatment system to allow heat transfer printing of fabrics with disperse dyestuffs. The pretreatment system is composed of highly methylated melamine-formaldehyde crosslinking agent, para-toluene sulfonic acid catalyst or ammonium or magnesium salt of the acid, triethylamine neutralizing agent, carboxyl vinyl polymeric thickening agent, and alcohol solvent. The formulation may also include other additives such as methoxy, ethoxy and butoxy triethylene glycol and cationically emulsified low density polyethylene to enhance color yield. The formulation is applied to one side of the fabric by a screen printing technique in which case the screen does not contain any pattern. If the carboxy vinyl polymeric thickening agent is eliminated from the formulation, the pretreatment system can be sprayed onto the fabric without having to impregnate the entire sample. This is particularly useful if the fabric is in the form of a garment. In this case only that portion of the garment that is to be printed need be treated.

The process of Faulhaber in U.S. Pat. No. 4,063,879 specifies that the catalyst used in transfer printing for resin curing is selected from a group consisting of ammonium chloride, magnesium chloride, triethanol ammonium chloride, tributylammonium chloride, 1,3-diaminopropanol hydrochloride, ammonium nitrate, zinc nitrate, ammonium thiocyanate, maleic acid, tartaric acid, and fumaric acid. The catalyst is not applied to the fabric simultaneously with the crosslinking agent as in the instant invention, but is applied to the paper containing the dyestuff and then transferred to the fabric during printing. The instant invention employs an entirely different catalyst, para toluene sulfonic acid, or salt of said acid which is a free acid, and not normally used in high temperature curing of cellulose. The catalyst and the methylated melamine-formaldehyde are mixed together in a single formulation and applied to the textile prior to heat transfer printing.

The process of Vellins et al, U.S. Pat. No. 4,072,462 specifies the use of certain disperse dyes with reactive groups that are reactive with the aminoplast. Catalysts that initiate the crosslinking of cellulose are selected from magnesium chloride, ammonium chloride, triethanol ammonium chloride, tributylammonium chloride, 1,3-diaminopropanol hydrochloride, ammonium nitrate, zinc nitrate, ammonium triocyanate, maleic acid, acetic acid, tartaric acid, and fumaric acid. The fabric must be free of alkalinity prior to resin treatment. The process of the instant invention specifies the use of a very strong acid catalyst such as paratoluene sulfonic acid. The solution containing crosslinking agent and catalyst is stabilized by use of triethylamine such that the pH can be either on the acid or basic side and transfer printing results are not impaired. Solutions with a pH in the range of 8–9 are stable for extremely long periods of time and the colorfastness to washing of the printed fabrics is very good indicating that crosslinking occurs even though the treating solution is basic.

DESCRIPTION OF THE PREFERRED EMBODIMENTS

We have found that cellulose-containing fabrics in garment form can be heat transfer printed by selectively treating the fabric with a formulation containing a highly methylated melamine-formaldehyde crosslinking agent and other necessary additives.

The highly methylated melamine-formaldehyde crosslinking agent used in the instant invention is of the formula:

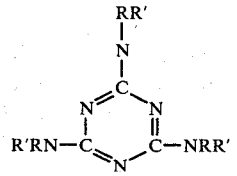

where R is $—CH_2OCH_3$ and R′ is either $—CH_2OCH_3$, $—CH_2OH$, or H. The preferred R′ is 0 or 1 radical per mole of $CH_2OCH_3$.

The process allows the fabric to be treated only in the area that is to be printed. This reduces chemical costs by concentrating the formulation in the desired area, such as on the front of a T-shirt where printing will occur.

The pretreatment system for treating the fabric is composed of a highly methylated melamine-formaldehyde crosslinking agent, para-toluene sulfonic acid catalyst or the ammonium or magnesium salt of said catalyst, triethylamine neutralizing agent, polymeric carboxy vinyl thickening agent in which the thickening agent is selected from a class of polyacrylic acid polymers with molecular weights in the range of 450,0000 to 4,000,000, and isopropanol solvent. The formulation may also include other additives such as methoxy, ethoxy, and butoxy triethylene glycol and cationically emulsified low density polyethylene fabric softener to enhance color yield. Other emulsified low density polyethylene fabric softeners are suitable; however, Velvetol 77-27, manufactured by Quaker Chemical Company of Conshohocken, Pennsylvania was used in the instant invention.

The methylated melamine-formaldehyde crosslinking agent may be used from about 5 g to 20 g for each 100 g of formulation or 5% to 20% by weight of the aqueous treatment formulation. The p-toluene sulfonic acid catalyst or ammonium or magnesium salt of said catalyst is used from about 0.05% to 0.4% by weight of the treatment formulation. The triethylamine is used from 0.04% to 0.5%. The cationically emulsified low density polyethylene softener is used from 0.5% to 2.0%. The polymeric carboxy vinyl thickener can be used from about 0.5% to 1.5%. The concentration of isopropanol should be from about 5% to 15%. Other additives can also be added to enhance color yield such as methoxy, ethoxy, and butoxy triethylene glycol which should be used from about 1.25% to 5%.

After the desired formulation has been prepared it can be applied to a limited portion of the fabric by screen printing in the form of a thickened formulation in which case the polymeric carboxy vinyl thickening agent is included or by spraying in which case the carboxy vinyl agent is omitted from the formulation.

The advantage of applying the thickened solution to a limited portion of the fabric by screen printing is that existing printing equipment and screens that are used for pigment printing are utilized. The screen is placed over the garment, such as a T-shirt. The thickened formulation is then deposited on the screen and printed onto the fabric surface in the usual manner with a squeege, except that the screen does not contain a design and the formulation does not contain a colored pigment. After the thickened solution is printed onto the fabric surface, the fabric is dried either at room temperature or up to 150° C. from 60 minutes to 1.5 minutes. The garment is then heat transfer printed by placing a design containing disperse dyestuffs of any type face down onto the treated portion of the garment and then heating in a press for 20–30 seconds at 190° C. to 210° C. Upon removing the paper from the fabric, a garment with a more highly colored and better defined print than that obtained by pigment screen printing is produced.

The formulation can also be sprayed onto the fabric surface. In this case the polymeric carboxy vinyl thickening agent is omitted to prevent an increase in viscosity. All other components of the formulation are incorporated. Drying, curing, and printing conditions are the same as those used for fabrics treated with the thickened formulation.

The following examples further describe the invention. They are given as illustration and should not be considered as limiting the scope of the invention.

EXAMPLE 1

A thickened solution was prepared such that in each 100 g there were 5 g highly methylated methylolmelamine, 0.05 g p-toluene sulfonic acid, 0.5 g triethylamine, 1.25 g butoxy triglycol, 0.5 g polymeric carboxy vinyl thickener, 3.75 g 2-propanol, and 88.95 g water.

Both 50/50 cotton-polyester and 100% cotton interlock fabrics weighing approximately 5.2 oz/sq yd were used for treatments. Samples were treated on one side with the thickened solution containing the modified melamine crosslinking agent by screen printing the fabric through a 10 xx mesh screen. After printing, the fabric was dried for 5 minutes at 100° C. The add-on was about 4.9%.

The samples were transfer printed with transfer printing paper containing disperse dye on a heat transfer machine with a 15×15 inch platen. Printing conditions were 204° C. for 30 seconds. Reflectance measurements of the samples that were printed with a transfer printing paper containing a black dyestuff formulation are shown in Table I.

TABLE I

| | Photovolt Reflectance | | Coloration |
|---|---|---|---|
| Sample | Initial | 5 Washings | Initial |
| 100% Cotton | 5.0 | 9.0 | Deep |
| 100% Cotton Control | 14.1 | 32.7 | Light |
| 50/50 C/PE | 5.8 | 6.3 | Deep |
| 50/50 C/PE Control | 12.0 | 14.2 | Dull |

These results demonstrate that the affinity of cellulose-containing fabrics is significantly increased by pretreating the fabrics with the thickened solution containing 5% methylated methylolmelamine and that durability of the prints to washing is good.

EXAMPLE 2

A thickened solution was prepared such that in each 100 g there were 10 g of highly methylated methylolmelamine, 0.2 g p-toluene sulfonic acid, 0.5 g triethylamine, 2.5 g butoxy triglycol, 7.5 g 2-propanol, 78.8 g water and 0.5 g polymeric carboxy vinyl thickener. After printing the fabrics as in Example I, the fabrics were dried for 5 minutes at 100° C. The add-on was about 7%.

The same procedure for transfer printing the samples as in Example I was used. Reflectance measurements of the samples that were printed with a black dyestuff formulation are shown in Table II.

TABLE II

| Sample | Photovolt Reflectance Initial | Photovolt Reflectance 5 Washings | Coloration Initial |
|---|---|---|---|
| 100% Cotton | 5.0 | 8.2 | Deep |
| 100% Cotton Control | 14.1 | 32.7 | Light |
| 50/50 C/PE | 5.1 | 6.5 | Deep |
| 50/50 C/PE Control | 12.0 | 14.2 | Dull |

These results demonstrate that the affinity of cellulose-containing fabrics is significantly increased by pretreating the fabrics with the thickened solution containing 10 percent highly methylated methylolmelamine.

EXAMPLE 3

A thickened solution was prepared such that in each 100 g there were 20 g highly methylated methylolmelamine, 0.2 g p-toluene sulfonic acid, 0.5 g butoxy triglycol, 15 g 2-propanol, 58.3 g water, and 0.5 g polymeric carboxyl vinyl thickener. After printing the fabrics as in Example I, the fabrics were dried for 5 minutes at 100° C. The add-on was about 17.3%.

The same procedure for transfer printing the samples as in Example I was used. Reflectance measurements of the samples that were printed with transfer printing paper containing a black dyestuff formulation are shown in Table III.

TABLE III

| Sample | Photovolt Reflectance Initial | Photovolt Reflectance 5 Washings | Coloration |
|---|---|---|---|
| 100% Cotton | 5.0 | 7.8 | Deep |
| 100% Cotton Control | 14.1 | 32.7 | Light |
| 50/50 C/PE | 4.8 | 6.4 | Deep |
| 50/50 C/PE Control | 12.0 | 14.2 | Dull |

The results demonstrate that the affinity of cellulose-containing fabrics is significantly increased by pretreating the fabrics with the thickened solution containing 20 percent highly methylated methylolmelamine.

EXAMPLE 4

A thickened solution was prepared such that in each 100 g there were 12 g highly methylated melamine-formaldehyde containing 3–4 radicals of $—CH_2OCH_3$ per mole, 0.12 g p-toluene sulfonic acid, 0.5 g triethylamine, 3 g butoxy triglycol, 0.5 g carboxyl vinyl thickener, 9 g 2-proponal, and 74.88 g water.

Both a 50/50 cotton-polyester and a 100% cotton plain jersey knit shirt were used for treatments. The garments were treated on the front side by screen printing with the solution through a 20 mesh screen. Only one side of the garments was treated. The garments were dried for 1.5 minutes at 150° C. The knit shirts were then heat transfer printed with transfer printing paper containing disperse dyestuffs for 30 seconds at 190° C. The resulting knit shirts had prints with bright deep colors in contrast to the dull light colors on the untreated control shirts. After 10 washings, the treated shirts had very good color retention for the 50/50 cotton-polyester and fair color retention for the 100% cotton. This was in contrast to the unacceptable appearance of the untreated cotton shirts.

The results demonstrate that 100% cotton and especially 50/50 cotton-polyester knit shirts can be readily treated with the designated formulation by means of a screen printing technique to substantially increase the affinity of the cellulose-containing garment for disperse dyestuffs. Further, it is demonstrated that through the use of screen printing techniques any specified area of the fabric can be treated after the fabric has been converted into garment form.

EXAMPLE 5

A thickened solution was prepared which was composed of 10 g highly methylated melamine-formaldehyde containing 3–4 radicals of $—CH_2OCH_3$ per mole, 0.1 g para-toluene sulfonic acid, 0.5 g triethylamine, 0.5 g polymeric carboxy vinyl thickener, 1 g cationically emulsified low density polyethylene softener, 15 g isopropanol, and 72.9 g water. The formulation was used to treat one side of a 50/50 cotton-polyester interlock fabric weighing approximately 5.2 oz/sq yd by a screen printing technique using a 10xx mesh screen. The solution was deposited mainly on the surface of the fabric. After printing, the fabric was dried for 5 minutes at 100° C. and then heat transfer printed with transfer paper containing Disperse Red 60 dye. The fabric was printed at 210° C. for 30 seconds. A fabric with a deep red color was obtained in which both the polyester and cotton fibers were evenly dyed. The prints had good colorfastness to washing in hot water with commercial detergent.

EXAMPLE 6

A single knit jersey T-shirt was treated with the same formulation as in Example 5 except 0.4 g (per 100 g of solution) of the magnesium salt of para-toluene sulfonic acid was used. The garment was dried and heat transfer printed as in Example 5 with a transfer printing paper containing black, blue, green, orange, red, and yellow disperse dyestuffs. The printed shirt had a bright and deep coloration with good colorfastness to washing.

EXAMPLE 7

The same formulation and procedure for treating the fabric as in Example 5 was used except the fabric was in the form of a T-shirt constructed of single knit jersey. The shirt was printed with a design composed of several disperse dyestuffs. After heat transfer printing, a beautiful design with deep coloration, including black, blue, green, orange, and yellow disperse dyes was produced. A 50/50 cotton-polyester shirt that was not treated but heat transfer printed had a washed out appearance because the disperse dyestuffs were absorbed only by the polyester component of the fabric.

EXAMPLE 8

A solution was prepared which was composed of 8 g of highly methylated melamine-formaldehyde containing 3–4 radicals of $—CH_2OCH_3$, 0.08 g para-toluene sulfonic acid, 0.08 g triethylamine, 1 g cationically emulsified low density polyethylene, 10 g isopropanol, and 80.84 g water. The solution had a pH of 9.0. The solution was sprayed onto a piece of 50/50 cotton-polyester interlock fabric. The fabric was dried for 1.5 minutes at 150° C. and then heat transfer printed with transfer paper containing Disperse Red 60 Dye at 210° C. for 30 seconds. The fabric had a deep red color indicating that both the cotton and polyester fibers were dyed. The printed fabric was washed in hot water with a commercial detergent for a total of ten cycles. There was very little color difference between the washed sample and the unwashed sample.

EXAMPLE 9

A solution was prepared as in Example 8 except that 0.04 g triethylamine per 100 g solution was used. The pH of the solution was 6.8. A 50/50 cotton-polyester fabric was treated and printed as in Example 8 with the same results for colorfastness to washing.

We claim:

1. A process for improving the affinity of cellulosic fabrics for disperse dyestuffs, the process comprising:
   (a) treating the fabric with an aqueous formulation of highly methylated melamine-formaldehyde cross-linking agent, triethylamine neutralizing agent, acid catalyst, alcoholic solvent, carboxyl vinyl polymeric thickening agent, and cationically emulsified low density polyethylene;
   (b) drying the fabric; and then
   (c) heat transfer printing with a transfer printing paper containing disperse dyestuff.

2. The process of claim 1 wherein the acid catalyst is selected from a group consisting of para toluene sulfonic acid and the ammonium and magnesium salts of para-toluene sulfonic acid.

3. The process of claim 1 wherein the aqueous formulation further includes a triglycol selected from a group consisting of methoxy triglycol, ethoxy triglycol, and butoxy triglycol.

4. The process of claim 1 wherein the cellulosic fabric is treated by screen printing in the designated area only on one side.

5. The process of claim 1 wherein the cellulosic fabric is in the form of a garment, such as a T-shirt.

6. A process for improving the affinity of cellulosic fabrics for disperse dyestuffs, the process comprising:
   (a) treating the fabric with an aqueous formulation of highly methylated melamine-formaldehyde cross-linking agent, triethylamine, para-toluene sulfonic acid or the ammonium or magnesium salt of said acid, alcoholic solvent, and cationically emulsified low density polyethylene.

7. The process of claim 6 wherein the fabric is treated with the aqueous formulation by spraying onto one side of the fabric.

8. The process of claim 6 wherein the fabric is in garment form.

9. A process for improving the affinity of cellulosic fabrics for disperse dyestuffs, the process comprising:
   (a) treating the fabric with an aqueous formulation of highly methylated melamine formaldehyde cross-linking agent, para-toluene sulfonic acid catalyst, isopropanol, and cationically emulsified low density polyethylene fabric softener;
   (b) drying the fabric; and then
   (c) heat transfer printing the fabric with a transfer printing paper containing disperse dyestuff.

10. A process for improving the affinity of cellulosic fabrics for disperse dyestuffs, the process comprising:
   (a) treating the fabric with an aqueous formulation of highly methylated melamine formaldehyde cross-linking agent, sulfonic acid salt catalyst selected from the group consisting of the ammonium and magnesium salts of said acid, isopropanol, and cationically emulsified low density polyethylene,
   (b) drying the fabric; and then
   (c) heat transfer printing the fabric with a transfer printing paper containing disperse dyestuff.

* * * * *